US008571460B2

(12) United States Patent
deJong et al.

(10) Patent No.: US 8,571,460 B2
(45) Date of Patent: Oct. 29, 2013

(54) CALCULATION OF CORRECTION FACTORS FOR LEAD EDGE SENSOR MEASUREMENT IN DUPLEX REGISTRATION

(75) Inventors: Joannes N. M. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 1177 days.

(21) Appl. No.: 12/480,917

(22) Filed: Jun. 9, 2009

(65) Prior Publication Data

US 2010/0308532 A1 Dec. 9, 2010

(51) Int. Cl.
*B65H 5/34* (2006.01)

(52) U.S. Cl.
USPC ..... 399/396; 271/265.02; 271/270; 399/394

(58) Field of Classification Search
USPC ..... 399/394, 396; 271/270, 265.02
See application file for complete search history.

(56) References Cited

U.S. PATENT DOCUMENTS

| | | | | |
|---|---|---|---|---|
| 4,763,160 | A * | 8/1988 | Honjo | 399/17 |
| 5,094,442 | A | 3/1992 | Kamprath et al. | |
| 5,278,624 | A | 1/1994 | Kamprath et al. | |
| 5,510,877 | A | 4/1996 | Dejong et al. | |
| 5,697,608 | A * | 12/1997 | Castelli et al. | 271/228 |
| 5,715,514 | A | 2/1998 | Williams et al. | |
| 6,059,285 | A | 5/2000 | Suga et al. | |
| 6,195,518 | B1 | 2/2001 | Bennett et al. | |
| 6,374,075 | B1 * | 4/2002 | Benedict et al. | 399/395 |
| 6,533,268 | B2 | 3/2003 | Williams et al. | |
| 6,575,458 | B2 | 6/2003 | Williams et al. | |
| 6,751,437 | B2 * | 6/2004 | Shimazu | 399/396 |
| 6,834,853 | B2 | 12/2004 | Trovinger et al. | |
| 6,866,260 | B2 | 3/2005 | Williams et al. | |
| 6,904,255 | B2 | 6/2005 | Kera et al. | |
| 7,177,585 | B2 | 2/2007 | Matsuzaka et al. | |
| 7,184,153 | B2 | 2/2007 | Leonhardt | |
| 7,219,888 | B2 | 5/2007 | Trovinger et al. | |

(Continued)

FOREIGN PATENT DOCUMENTS

| | | |
|---|---|---|
| DE | 44 01 9002 C2 | 9/1998 |
| EP | 1 445 664 A2 | 11/2004 |

OTHER PUBLICATIONS

U.S. Appl. No. 12/371,110, filed Feb. 13, 2009, entitled Substrate Media Registration and De-Skew, Apparatus, Method and System.

(Continued)

*Primary Examiner* — Kaitlin Joerger
*Assistant Examiner* — Ernesto Suarez
(74) *Attorney, Agent, or Firm* — Hoffmann & Baron, LLP

(57) ABSTRACT

A method and system for insuring printing accuracy in simplex imaging or duplex imaging, including a media sheet in a media path adapted to move the media sheet through the system. The media path includes sensors and a datum. The sensors include a leading edge sensor and a trailing edge sensor adapted to record the time of arrival of the edge. The edge arrival time difference is determined between the arrival time of the edge using output from the trailing edge sensor and the arrival time of the edge using output from the leading edge sensor. A correction factor is based upon the time difference. The time of arrival of the media sheet at the datum is determined using the correction factor to align items printed on both side of the media sheet.

17 Claims, 5 Drawing Sheets

(56) References Cited

U.S. PATENT DOCUMENTS

| | | | | |
|---|---|---|---|---|
| 7,243,727 | B2 | 7/2007 | Tudor et al. | |
| 7,277,669 | B2 | 10/2007 | Howe | |
| 7,320,461 | B2 | 1/2008 | Lofthus et al. | |
| 7,422,211 | B2 | 9/2008 | Dejong et al. | |
| 7,525,564 | B2 * | 4/2009 | Okamoto et al. | 347/262 |
| 7,837,191 | B2 * | 11/2010 | Katou et al. | 271/228 |
| 7,970,294 | B2 * | 6/2011 | Shin | 399/16 |
| 8,180,272 | B2 * | 5/2012 | Richards et al. | 399/388 |
| 2004/0251607 | A1 | 12/2004 | Mandel et al. | |
| 2006/0027271 | A1 | 2/2006 | Klipfel et al. | |
| 2006/0239733 | A1 * | 10/2006 | Choi et al. | 399/396 |
| 2006/0261540 | A1 | 11/2006 | Loiselle et al. | |
| 2007/0025788 | A1 | 2/2007 | deJong et al. | |
| 2007/0085265 | A1 | 4/2007 | DeJong et al. | |
| 2008/0240820 | A1 | 10/2008 | deJong et al. | |
| 2008/0258382 | A1 | 10/2008 | deJong et al. | |
| 2012/0013066 | A1 * | 1/2012 | deJong et al. | 271/227 |

OTHER PUBLICATIONS

U.S. Appl. No. 12/364,675, filed Feb. 3, 2009, entitled Modular Color Xerographic Printing Architecture.

U.S. Appl. No. 12/262,803, filed Oct. 31, 2008, entitled Method of and System for Module to Module Skew Alignment.

* cited by examiner

CALCULATION OF CORRECTION FACTORS FOR LEAD EDGE SENSOR MEASUREMENT IN DUPLEX REGISTRATION

TECHNICAL FIELD

This disclosure generally relates to substrate (paper) registration systems. More particularly, this disclosure concerns a correction factor for lead edge sensor measurements in duplex registration.

BACKGROUND

In many printing systems, sheets are fed from a feeder, registered with a paper registration system before it receives the image. The image is then fused onto the first side of the paper. The sheet is then inverted and routed to through the duplex path to present the second side of the paper to the imaging device.

Generally, the sheet registration device prepares the sheet for delivering to the datum and a target time. The preparation includes alignment of the sheet and time adjustments of delivery. Sensors measure the lateral and skew of the sheet. Adjustments to the sheet are made accordingly. At the same time, the sheet passes over a lead edge sensor which records or measures the sheet's position when it arrives at the registration system. This information is used to deliver the sheet at a target time to the registration datum (i.e. transfer) for imaging.

In a duplex system, different systems are used to deliver the inverted sheet to the datum at the target time. One system measures the lead edge on the first side and second side in the same manner using a lead edge sensor. The lead edge sensor records the time of arrival to the lead edge of the sheet. The arrival information is used to deliver the sheet at a target time to the datum regardless of which side of the sheet is being introduced at the time. However, sheet registration based on only the leading edge of the sheet regardless of inversion is inaccurate due to the sheet property variations of each side and edges of the paper. This system does not take into account a differentiation between the leading edge and trailing edge of a sheet and variations in the sheet sides.

Another system used to deliver a sheet to the datum at the target time is measuring the lead edge for one side and a trail edge for the inverted side. As above-discussed the first side of the sheet uses sensors to measure the lateral and skew and adjustments are made. The leading edge sensor is used to record the time of arrival of the leading edge of the first side of the sheet. The sheet is then delivered to the datum at the target time. After the image is fused onto the first side of the sheet, the sheet is inverted and sent back to the registration system for imaging on the second side. The registration system uses the sensors to measure lateral and skew, as similarly measured for the first side of the sheet. The sheet is adjusted accordingly. While the second side of the sheet is measured and adjusted, the trail edge sensor records the time of arrival of the trail edge of the second sheet (which is also the leading edge of the first side of the sheet). However, the trail edge sensors record inaccurate data because the sheet is being adjusted and moved during recordation of the trail edge.

Therefore, there is a desire for a system that provides accurate recordation and measurement of both sides of the sheet to deliver the sheet to the datum at the target time. Additionally, the system must be flexible enough to provide for accurate delivery of sheets that vary in size and other properties. Further, there is a desire to provide a system for providing accurate delivery to the datum that can compensate for variations and delaying within the system itself.

SUMMARY OF THE INVENTION

According to aspects illustrated herein, there is provided a system and method for insuring printing accuracy in simplex imaging or duplex imaging, including a media sheet in a media path adapted to move the media sheet through the system. The media path includes sensors and a datum. The sensors include a leading edge sensor and a trailing edge sensor adapted to record the time of arrival of the edge. The edge arrival time difference is determined between the arrival time of the edge using output from the trailing edge sensor and the arrival time of the edge using output from the leading edge sensor. A correction factor is based upon the time difference. The time of arrival of the media sheet at the datum is determined using the correction factor to align items printed on both side of the media sheet.

According to other aspects illustrated herein, there is a print making device or a print making system. The system and device may include a media path adapted to move a media sheet. The media sheet includes a lead edge and a trail edge. The media path includes lead edge sensor, a trail edge sensor, registration device sensor, a velocity controller, and a datum. The lead edge sensor is between the trail edge sensor and the registration device sensor. The leading edge sensor records the time of arrival of the lead edge at the lead edge sensor, the trailing edge sensor to records the time of arrival of the trail edge at the trail edge sensor, the registration device sensor records the time of arrival of the lead edge at the registration device sensor. The velocity controller adjusts the velocity of the media sheet based on the difference between the arrival time of the lead edge at the lead edge sensor and the time of arrival of the trail edge at the trail edge sensor. The registration controller is operatively connected to the media path and to the sensors. The registration controller is adapted to calculate said difference between the arrival time of the trail edge using output from the trailing edge sensor and the arrival time of the lead edge using output from the leading edge sensor, calculate a correction factor based upon the time difference; and calculate a corrected time of interval of the media sheet from the lead edge sensors to the datum using the correction factor to align items printed on the media sheet, and notifies the velocity controller for adjusting the current velocity of the sheet based on the correction factor to deliver the media sheet to the datum at a predetermined time of arrival of the media sheet to the datum to provide accurate alignment of items to be printed on the media sheet.

Additional features and advantages will be readily apparent from the following detailed description, the accompanying drawings and the claims. It is to be understood, however, that the drawings are designed as an illustration only and not as a definition of the limits of the disclosure.

BRIEF DESCRIPTION OF THE DRAWINGS

Like reference symbols in the various drawings indicate like elements.

DETAILED DESCRIPTION OF THE INVENTION

A system and method disclosed herein insures printing accuracy in simplex imaging or duplex imaging system including a media sheet in a media path adapted to move the media sheet through the system.

As used herein, the phrase "simplex imaging or duplex imaging system" encompasses any apparatus, such as a digital copier, bookmaking machine, facsimile machine, and multi-function machine, which performs a printing outputting function for any purpose.

As used herein, the phrase "sheet" encompasses, for example, one or more of a usually flimsy physical sheet of paper, heavy media paper, coated paper, transparency, parchment, film, fabric, plastic, or other suitable physical print media substrate on which information can be reproduced.

As used herein, the phrase "media path" encompasses any apparatus for separating and/or conveying one or more sheets into a substrate conveyance path inside a print making device.

As used herein, the phrase "lead edge" refers to the edge of a sheet that first advances along the feed path.

As used herein, the phrase "trail edge" refers to the edge of a sheet that advances last along the feed path.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as refers to herein can include one or more point sensors and/or array sensors for detecting and/or measuring characteristics of a substrate media, such as speed, orientation, process or cross-process position and even the size of the substrate media. Thus, reference herein to a "sensor" may include more than one sensor.

Figure 1:
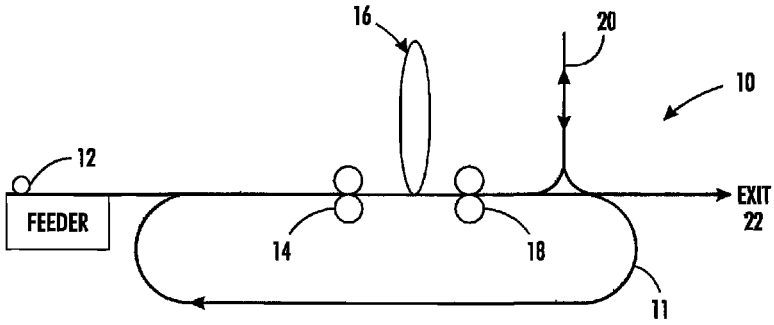
FIG. 1 PRIOR ART
FIG. 1 illustrates a prior art duplex paper path system.

As shown in the duplex media sheet path 10 in FIG. 1, media sheets are fed from a feeder 12, and registered with a media sheet registration system 14 before receiving the image from a marking device 16. The image is then fused onto the media by the fuser 18 and the sheet may or may not be inverted by the inverter 20 before it passes through the exit 22. Conventional marking devices, fusers, media sheet paths, etc. are discussed at length in U.S. Pat. No. 6,032,004, the complete disclosure of which is fully incorporated herein by reference. For duplex printing, the sheet must be inverted and routed through the duplex path 11 to present the second side to the imaging device 16. Note that inversion may also take place in the duplex path 16. Inversion transposes the lead edge of the first side of a sheet to the trail edge of the second side of a sheet; and similarly, the trail edge of first side of a sheet becomes the lead edge of the second side of the sheet.

Accurate timing of imaging fusion onto the sheet is important for proper alignment of the image on the sheet. Additionally, accurately timing the imaging on a second side of the sheet to evenly match the image on the first side of the sheet is important for proper alignment of the image. Thus, sensors are used to determine the position of the sheet in the duplex media path.

Figure 2:
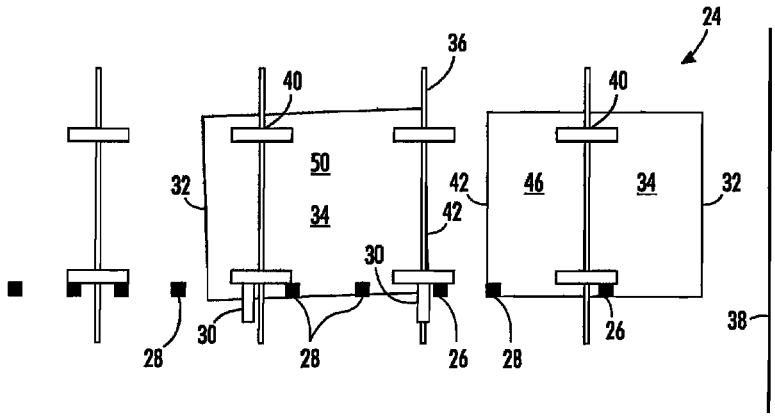
FIG. 2 PRIOR ART
FIG. 2 illustrates a partial block diagram of a sheet in a prior art media path.

As shown in FIG. 2, the sheet registration system 24 includes various sensors including alignment sensors 30, lead edge sensors 26 and a trail edge sensor 28. The lead edge sensors 26 measure the time of arrival of the lead edge 32 of the first side 46 of sheet 34. Subsequently, a process direction registration controller 36 generates an action to deliver the sheet to a registration datum 38 at a target time. For instance, a transport nip 40 between the registration device 36 and the registration datum 38 is used to adjust the velocity of the sheet 34 to deliver the lead edge 32 of the first side 46 of the sheet 34 to the registration datum 38 at the target time. After inversion, the lead edge 32 of the first side 46 of the sheet 34 becomes the trail edge of the second side 50 of the sheet 34. Calculating the target time for delivery of the second side 50 of the sheet 34 to the sheet registration device 36 and registration datum 38 based on the lead edge 32 of each side of the sheet 34 will yield an inaccurate result due to sheet property variations. Using the lead edge 32 and trail edge 42 of a sheet 34 to calculate the target time of arrival of the sheet to the registration datum 38 provides more accuracy as each sheet 34 and each edge of the sheet 34 vary. At the input of the registration system 24, the lead edge and trail edge of the first side 46 of the sheet 34 is established from measurements recoded by the lead edge sensor and the trail edge sensor. After inversion, the lead edge of the first side 46 of sheet 34 becomes the trail edge of the second side 50 of the sheet 34. Hence, any sheet size/geometry tolerances will cause registration errors if target times are only calculated at the lead edge sensor 26 only based on the different leading edges of the sheet's 34 side.

Figure 3:
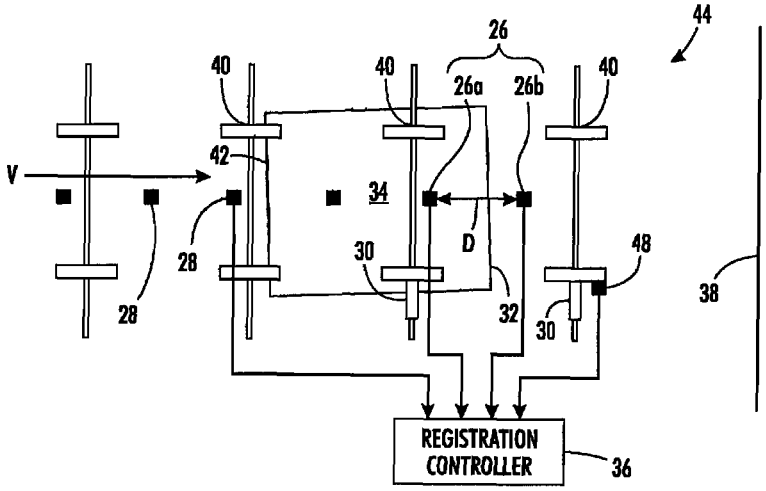
FIG. 3 illustrates a partial block diagram of an exemplary configuration of a first side of a sheet in a media path.
Figure 4A:
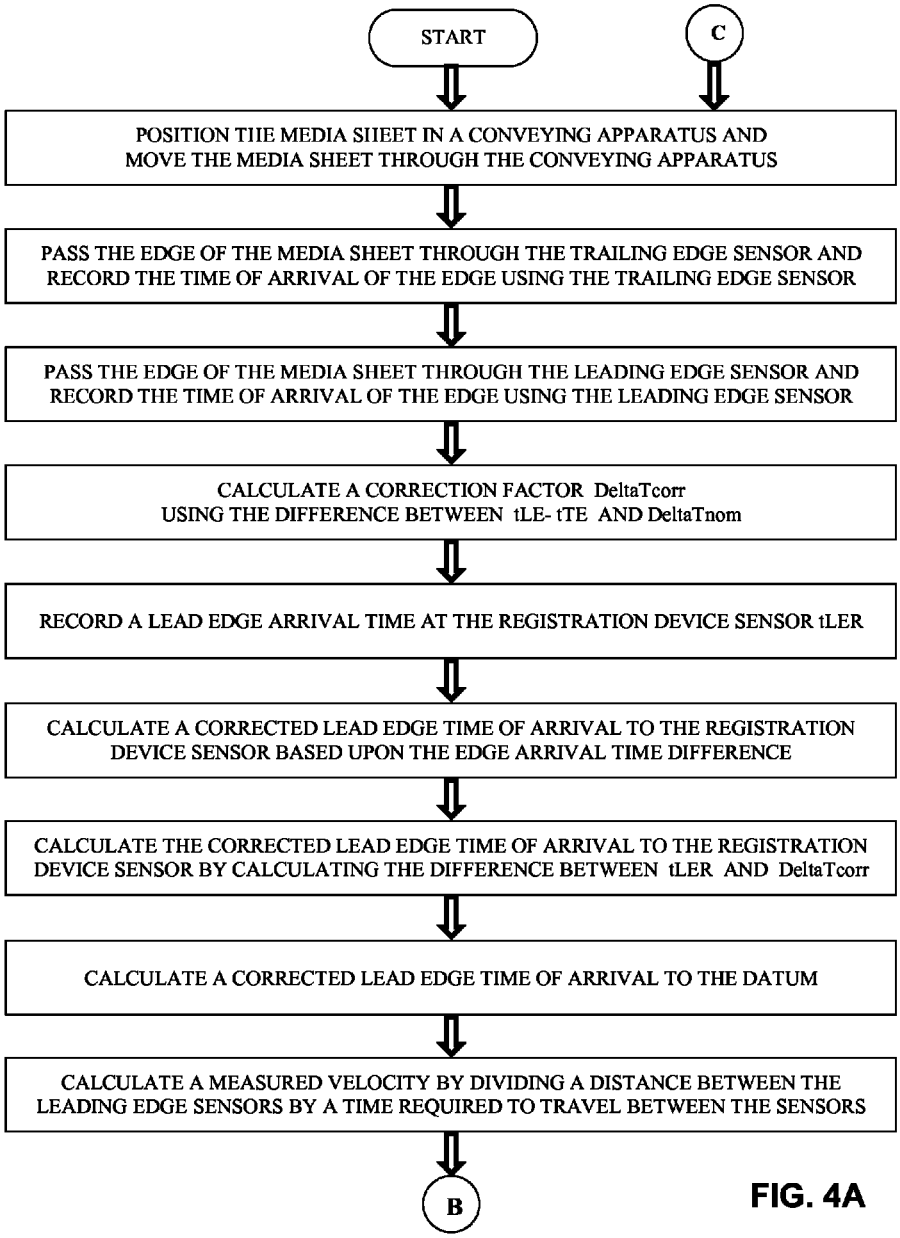
FIG. 4A illustrates the initial method steps for carrying out the invention.
Figure 4B:
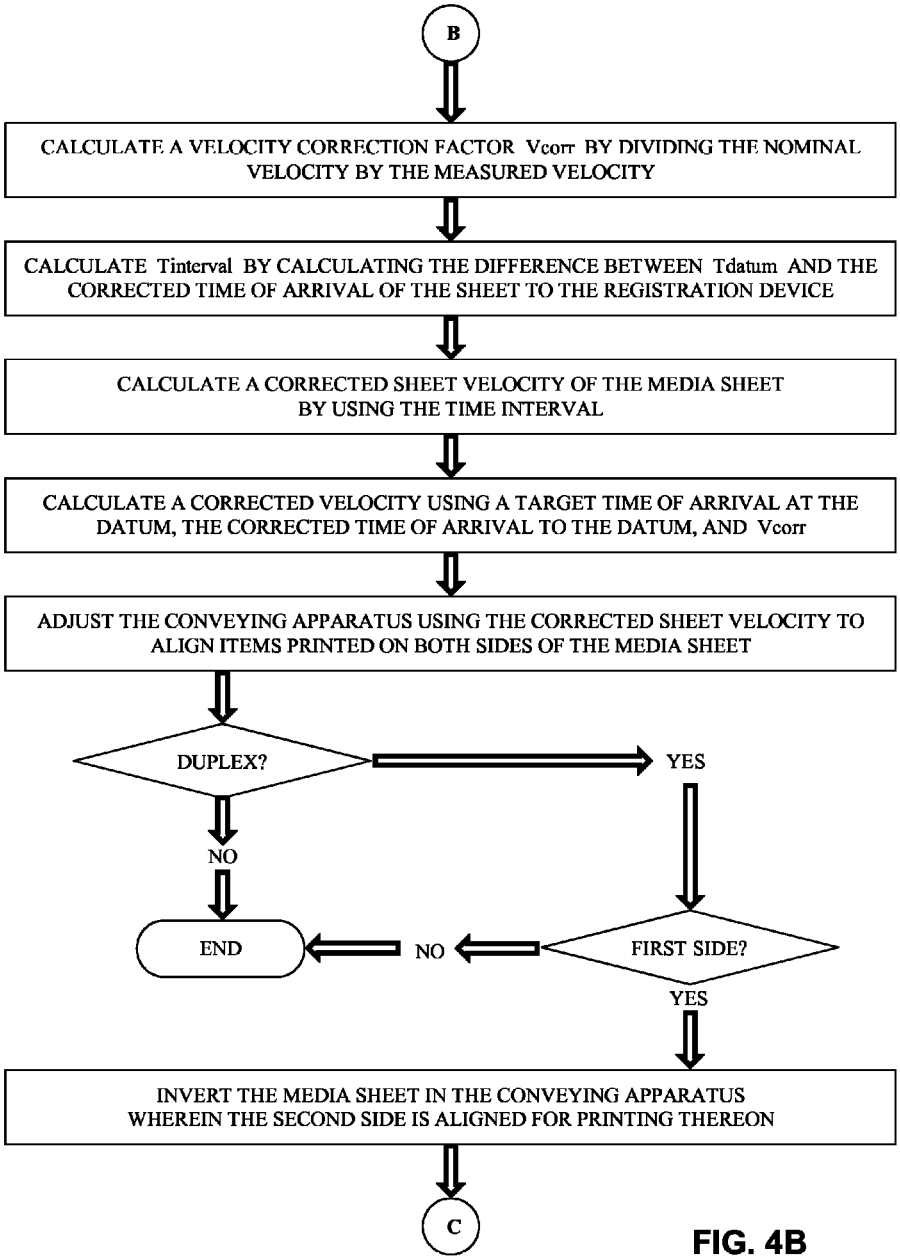
FIG. 4B illustrates the remaining method steps for carrying out the invention.

According to the aspects illustrated herein, provided is a device and method that computes a correction factor for lead edge sensors in simplex registration and a duplex registration. The embodiments do not require the sheet to be registered in lateral and skew. Additionally, as shown in FIG. 3, these embodiments do not require a transportation nip located between the sheet registration device and the registration datum to compensate for inaccurate target time delivery of the sheet by adjusting the velocity of the sheet to deliver the sheet. The embodiments provide accurate delivery of the sheet to the registration datum regardless of which side of the sheet is being processed through the system 44. These embodiments include one or more trail edge sensors 28 spaced apart in the direction of the velocity vector V. These embodiments also include one or more lead edge sensors 28 spaced apart in the direction of the velocity vector V. The difference in the time of arrival of the sheet lead edge 32 at the lead edge sensor 26 and the sheet time of arrival of the trail edge 42 at the trail edge sensor 28 is computed. The difference is subtracted from a nominal value assigned for a specific sheet dimension to provide a correction value. The correction value is used to determine the target time for the arrival of the sheets lead edge 32 to the registration datum 38. Accurately determining the time of arrival of a sheet 34 to the registration datum 38 provides accurate placing of an image onto that side of the sheet 34.

FIG. 3 shows a media registration system 44 of the present invention including a velocity vector path V, lead edge sensors 26, trail edge sensors 28, transport nips 40, a sheet registration device 36 and a registration datum 38. The velocity vector path V represents the path of movement that the sheet 34 follows through the system 44 from entrance to exit of the media sheet path.

The nips 40 are located along the velocity vector path V. The nips 40 control the velocity of the sheet 34 as the sheet moves along the velocity vector path V. The sheet registration device 36 is located after the last set of nips 40 and immediately before the registration datum 38. The registration device 36 with registration controller collects information and calculates the corrected target time of arrival of the sheet 34 lead edge 32 to the registration datum 38 or marking device. A row of trail edge sensors 28 are located along the velocity vector path V to collect and transmit to the registration device the time of arrival of the trail edge 42 of a sheet 34 introduced to the system 44. The trail edge sensors 28 may be located on the outer edge of the velocity vector path V adjacent the nips 40, or the trail edge sensors 28 may be positioned in the center of the velocity vector path V as shown in FIG. 3. The optimal location of trail edge sensors 28 is within the velocity vector path V and positioned to allow for sheets of various widths to pass by the sensor for arrival time recordation. Downstream from the trail edge sensors 28 is at least one leading edge sensor 26. FIG. 3 shows the lead edge sensor(s) 26 is located between the nip 40 and the sheet registration device 36 and similarly situated in the velocity vector path V as the trail edge sensors 28 to ensure a reading of a leading edge 32 for sheets 34 of various dimensions that travel through the system 44. The registration device 36 measures the arrival time of the lead edge 32 and/or trail edge 42 of the media sheet 34 when it arrives at the various sensors. The device of FIG. 3 can assume constant velocity of the sheet 34 through the system 44, or can accommodate varying velocity.

To achieve printing accuracy in duplex imaging system, both sheet side 1 and sheet side 2 need to be accurately delivered at the target time to a datum. If sheet side 1 registration employs a conventional registration strategy using a lead edge time of arrival and a target delivery time, then sheet side 2 must a use corrected lead edge time of arrival registration strategy. Conversely, if sheet side 2 registration employs a conventional registration strategy using a lead edge time of arrival and a target delivery time, then sheet side 1 must use a corrected lead edge time of arrival registration strategy.

FIG. 3 shows the process of insuring printing accuracy for simplex imaging or duplex imaging using a constant velocity transport nips 40. Initially, the sheet 34 enters the velocity vector path V and moves along the path past the various sensors. The leading edge sensor 26 records the time of arrival of the leading edge (tLE) of the sheet 34. The trail edge sensor 28 records the time of arrival of the trail edge (tTE) of the sheet 34. The last trail edge sensor 28 in which the trail edge 42 passes by before the lead edge sensor 28 records the lead edge 32 is used by the registration device 36 to calculate the correction factor for determining the time of arrival of the sheet 34 to the datum 38. The calculated time difference (DeltaT) between the two times of arrival of the edges (tTE and tLE) are calculated by the registration device 36, as follows:

$$\text{Delta}T = tLE - tTE$$

The calculated time difference (DeltaT) is subtracted by a nominal time difference (DeltaTnom) to provide the time correction factor (DeltaTcorr), as follows:

$$\text{Delta}T\text{corr} = \text{Delta}T - \text{Delta}T\text{nom}$$

DeltaTnom is a nominal value of DeltaT at a nominal velocity (Vnom) for a given sheet size and trail edge sensor calibration. DeltaTnom is an assigned value for a specific sheet's characteristics and associated trail edge sensor via calibration. The DeltaTnom is an external input to the device 44 and entered into the system and stored in memory of the sheet registration device 36 prior to the use of the system 44.

The time of arrival of the lead edge 32 of sheet 34 at the registration device (tLER) is measured at registration device sensor 48. The differences between the time of arrival of the sheet to the registration device (tLER) and the (DeltaTcorr), provides the corrected time of arrival of the sheet to the registration device (tLER'), is used by the registration controller to calculate a velocity profile to deliver the sheet to the datum at a time (Tdatum) as follows:

$$tLER' = tLER - \text{Delta}T\text{corr}$$

The time correction factor (DeltaTcorr), is used to provide an accurate time of arrival of the leading edge 32 of the sheet 34 to the registration datum 38. The desired arrival time of the leading edge 32 to the datum 38 (Tdatum) is a predetermined number set by the system controller which is an assigned valve associated with the specific sheet characteristics. The time interval (Tinterval) for the sheet 34 to travel from the sensor 48 to the datum 38 is as follows:

$$T\text{interval} = T\text{datum} - tLER'$$

The sheet registration device controller will adjust the sheet velocity to a corrected sheet velocity in the registration device 36 to accomplish this by use of velocity controllers such as the registration device, nips or other members that control velocity in a media path. The sheet 34 then passes through the datum 38 and the image is placed onto the surface of the sheet 34. The sheet 34 then exits the system 44 in a simplex imaging process or the sheet 34 is inverted in a duplex system for imaging on the second side. The sheet 34 is inverted or flipped over such that the leading edge 32 of the first side becomes trail edge of the second side. Similarly, the trail edge 42 of the first side of the sheet 34 becomes the leading edge of the second side of the sheet 34.

After the inversion the second side of the sheet does not require adjustment to the time of arrival to the registration datum 38. The measured time of arrival (tLER) is used to calculate the velocity profile. This adjusted the time interval (Tinterval) for the sheet to travel from registration sensor 48 to the datum 38. The first side used the corrected time of arrival (tLER) and the second side used the non-corrected time of arrival (tLER) to present the sheet to the datum 38. This calculation can also be reversed in that the first side uses the non-corrected time of arrival (tLER) and the second side uses the corrected time of arrival (tLER) to deliver the sheet to the datum 38 at the predetermined time.

Another aspect of FIG. 3 provides for varying velocity in the system. The embodiment includes additional leading edge sensors 26 (26*a*, 26*b*) to calculate the velocity of the sheet 34 and incorporate this information when calculating the target time of arrival of the sheet 34 to the datum 38. FIG. 3 shows two leading edge sensors 26*a* and 26*b* spaced apart at a fixed distance D. Each leading edge sensor 26 records the time of arrival of the leading edge 32 of the sheet 34 at that the leading edge of 26 sensors (Vcorr). The measured velocity (Vmeas) is calculated by the registration device 36. A velocity correction factor (Vcorr) is determined by dividing the nominal velocity (Vnom) by the measured velocity (Vmeas). The velocity correction factor (Vcorr) is used to determine the nominal time of arrival of the lead edge 32 to the datum 38. This nominal time of arrival is the externally input value assuming nominal velocity of the sheet 34 through the system 44. This nominal time (DeltaTnom) is compared to the measured time of arrival (DeltaT) recorded by the sensors (26, 28). The nominal time (DeltaTnom) is adjusted with the correction factor (Vcorr) to provide an adjusted nominal time (DeltaTnom). The correction factor (Vcorr) is applied to the recorded time of arrival of the sheet to the registration device 36 to determine the target time of arrival of the sheet to the datum 38.

FIG. 3 shows the process of insuring printing accuracy in duplex imaging using a lead edge sensor at the registration device 36 with or without a velocity correction factor to determine the target time of arrival of the sheet to the registration datum 38. Initially, the sheet 34 enters the velocity vector path and the calculations for each side is the same. The sheet 34 moves along the path past the various sensors. The leading edge sensor 26 records the time of arrival of the leading edge (tLE) of the sheet 34. The trail edge sensor 28 records the time of arrival of the trail edge (tTE) of the sheet 34. The trail edge sensor 28 that is used by the registration device 36 is the last trail edge sensor 28 that the trail edge of the sheet 34 passes through before the lead edge sensor 26*a* records the first time of arrival of the leading edge ($tLE_a$) of the sheet 34. The leading edge sensor 26*b* records the second time of arrival of the leading edge ($tLE_b$) of the sheet. The calculated time difference (DeltaT) between the second times of arrival ($tLE_b$) of the lead edges and the first time of arrival of the lead edge ($tLE_a$) is calculated by the registration device controller, as follows:

$$\text{Delta}T = tLE_b - tLE_a$$

The velocity measurement (Vmeas) is calculated by the registration device controller by dividing the distance D between the times of arrival of the leading edge sensors (26*a* & 26*b*) by the calculated time difference (DeltaT) as follows:

$$V\text{meas} = D/(\text{Delta}T) = D/(tLE_b - tLE_a)$$

The nominal velocity (Vnom) is divided by measuring velocity (Vmeas) to provide the velocity correction factor (Vcorr).

$$V\text{corr} = V\text{nom}/V\text{meas}.$$

An adjusted nominal value (DeltaTnom') is calculated by using the nominal value (DeltaTnom) at the nominal velocity (Vnom) multiplied by the velocity correction factor (Vcorr), as follows:

$$\text{Delta}T\text{nom}' = \text{delta}T\text{nom}(V\text{corr})$$

DeltaTnom is a nominal value of time at a nominal velocity for a given sheet size and trail edge sensor calibration. DeltaTnom is entered into the system and stored in memory of the sheet registration device prior to the use of the system.

The adjusted nominal time difference (DeltaTnom) and the time difference (DeltaT) is used to calculate the corrected time difference (DeltaTcorr), as follows:

$$\text{Delta}T\text{corr} = \text{Delta}T - \text{Delta}T\text{nom}'$$

The arrival time of the leading edge (tLER) at the registration device sensor 48 located by the registration device 36 is recorded. The difference between the time of arrival of the leading edge of the sheet 34 to the registration device and the (DeltaTcorr) is used by the registration controller to calculate the velocity profile to deliver the sheet to the datum at a time (Tdatum), as follows:

$$tLER' = tLER - \text{Delta}T\text{corr}$$

The sheet registration device controller will adjust the sheet velocity in the registration device 36 to accomplish on time delivery to the sheet to the datum.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A method for insuring printing accuracy in simplex and duplex imaging, for use in connection with at least one of an electrostatographic and a xerographic machine, the method comprising:

providing a media sheet including a first side, a second side, a lead edge and a trail edge;

positioning the media sheet in a conveying apparatus adapted to move the media sheet, the conveying apparatus including sensors and a datum, the sensors including a first leading edge sensor and a second leading edge sensor downstream of the first leading edge sensor to record the time of arrival of the sheet lead edge, and a trailing edge sensor adapted to record the time of arrival of the sheet trail edge;

moving the media sheet through the conveying apparatus;

calculating an edge arrival time difference between the arrival time of the sheet trail edge using output from the trailing edge sensor and the arrival time of the sheet lead edge using output from the leading edge sensor;

calculating a correction factor using the difference between the edge arrival time difference and a predetermined arrival time difference between the lead edge and trail edge at the sensors;

providing a registration device sensor, and recording a recorded lead edge arrival time at the registration device sensor;

calculating a corrected lead edge time of arrival of the sheet to the registration device sensor based upon the edge arrival time difference;

calculating a corrected lead edge time of arrival of the sheet to the datum;

establishing a nominal velocity of the media sheet;

calculating a measured velocity by dividing a distance between the first and second leading edge sensors by a time required to travel between the sensors;

calculating a velocity correction factor by dividing the nominal velocity by the measured velocity;

calculating a corrected sheet velocity using a target time of arrival of the media sheet at the datum, the corrected lead edge time of arrival of the sheet to the datum, and the velocity correction factor; and adjusting the conveying apparatus using the corrected sheet velocity to align items printed on both sides of the media sheet.

2. The method according to claim 1, wherein the moving step includes passing the trail edge of the media sheet through the trailing edge sensor and recording the time of arrival of the trail edge using the trailing edge sensor.

3. The method according to claim 2, wherein the moving step includes passing the lead edge of the media sheet through the leading edge sensor and recording the time of arrival of the lead edge using the leading edge sensor.

4. The method according to claim 2, wherein the moving step includes passing the first side of the media sheet through the trailing edge sensor.

5. The method according to claim 2, wherein the moving step includes passing the second side of the media sheet through the trailing edge sensor.

6. The method according to claim 1, further including the step of inverting the media sheet in the conveying apparatus wherein the second side is aligned for printing thereon.

7. The method according to claim 6, further including the step of moving the media sheet through the conveying apparatus to the datum at the corrected sheet velocity of the conveying apparatus.

8. The method according to claim 1, further including the step of calculating the corrected lead edge time of arrival of the sheet to the registration device sensor by calculating the difference between the recorded lead edge time of arrival at the registration device sensor and the correction factor.

9. The method according to claim 8, further including the step of calculating a time interval between the registration device sensor and the datum by calculating the difference between a predetermined time of arrival of the lead edge to the datum and the corrected time of arrival of the sheet to the registration device.

10. The method according to claim 9, wherein the step of calculating a corrected sheet velocity of the media sheet is calculated by using the time interval.

11. A print making device comprising:

a conveying apparatus adapted to move a media sheet, the media sheet including a lead edge and a trail edge;

the conveying apparatus including sensors, a velocity controller and a datum;

the sensors including a leading edge sensor to record a time of arrival of the lead edge, a trailing edge sensor to record a time of arrival of the trail edge and a registration device sensor;

the velocity controller being adapted to adjust the velocity of the media sheet based on a difference between the arrival time of the lead edge and the time of arrival of the trail edge; and a registration controller operatively connected to the conveying apparatus and to the sensors, the registration controller being adapted to calculate an edge arrival calculated time difference between the arrival of the trail edge using output from the trailing edge sensor and the arrival time of the lead edge using output from the leading edge sensor, calculate a correction factor based upon the calculated time difference minus a nominal time difference, and calculate a corrected time interval of the media sheet from the registration device sensor to the datum using the correction factor and a predetermined time of arrival of the media sheet to the datum to align items printed on the media sheet, and notify the velocity controller for adjusting the current velocity of the sheet based on the correction factor to deliver the media sheet to the datum at the predetermined time of arrival of the media sheet to the datum to provide accurate alignment of items to be printed on the media sheet.

12. The apparatus according to claim 11, wherein the conveying apparatus is adapted to pass the edge of the media sheet through the leading edge sensor, and the conveying apparatus is adapted to pass the trail edge of the media sheet through the trail edge sensor.

13. The apparatus according to claim 12, wherein the conveying apparatus includes a row of trail edge sensors along the conveying apparatus.

14. The apparatus according to claim 13, wherein the conveying apparatus includes an inverter to invert the media sheet to allow for printing on both sides of the media sheet.

15. The apparatus according to claim 14, wherein the conveying apparatus includes two lead edge sensors spaced apart at a predetermined distance, the two lead edge sensors being adapted to record the time of arrival of the lead edge, so that the registration controller the current velocity in the conveying apparatus based on the difference between the recorded time of arrival of the lead edge divided by the predetermined distance.

16. The apparatus according to claim 11, further comprising at least one of an electrostatographic and a xerographic machine and process.

17. A print making system comprising:

a conveying apparatus adapted to move a media sheet, the media sheet including a lead edge and a trail edge;

the conveying apparatus comprising a leading edge sensor, a trailing edge sensor, a registration device sensor, a velocity controller and a datum;

the leading edge sensor being between the trailing edge sensor and the registration device sensor;

the leading edge sensor records the time of arrival of the lead edge at the leading edge sensor, the trailing edge sensor records the time of arrival of the trail edge at the trailing edge sensor, the registration device sensor records the time of arrival of the lead edge at the registration device sensor;

the velocity controller adjusts the velocity of the media sheet based on the difference between the arrival time of the lead edge at the leading edge sensor and the time of arrival of the trail edge at the trailing edge sensor; and a registration controller operatively connected to the conveying apparatus and to the sensors, the registration controller being adapted to calculate the difference between the arrival time of the trail edge using output from the trailing edge sensor and the arrival time of the lead edge using output from the leading edge sensor, calculate a correction factor based upon the time difference; and calculate a corrected time interval of the media sheet from the registration device sensor to the datum using the correction factor and a predetermined time of arrival of the media sheet to the datum to align items printed on the media sheet, and notify the velocity controller for adjusting the current velocity of the sheet based on the correction factor to deliver the media sheet to the datum at the predetermined time of arrival of the media sheet to the datum to provide accurate alignment of items to be printed on the media sheet.

* * * * *